US011285639B2

(12) United States Patent
Scott et al.

(10) Patent No.: US 11,285,639 B2
(45) Date of Patent: Mar. 29, 2022

(54) PORTABLE MIXER FOR HYDRATING AND MIXING CEMENTITIOUS MIX IN A CONTINUOUS PROCESS

(71) Applicant: Red Dog Mobile Shelters, LLC, Amarillo, TX (US)

(72) Inventors: Rick Scott, Lubbock, TX (US); Tim Gragson, Lubbock, TX (US); Randy Lacy, Lubbock, TX (US)

(73) Assignee: RED DOG MOBILE SHELTERS, LLC, Amarillo, TX (US)

( * ) Notice: Subject to any disclaimer, the term of this patent is extended or adjusted under 35 U.S.C. 154(b) by 155 days.

(21) Appl. No.: 16/777,556

(22) Filed: Jan. 30, 2020

(65) Prior Publication Data

US 2021/0237310 A1 Aug. 5, 2021

(51) Int. Cl.

| | |
|---|---|
| ***B28C 5/12*** | (2006.01) |
| ***B28C 5/08*** | (2006.01) |
| ***B28C 7/06*** | (2006.01) |
| ***B28C 7/12*** | (2006.01) |
| ***B28C 5/14*** | (2006.01) |

(52) U.S. Cl.

CPC ..... *B28C 5/1215* (2013.01); *B28C 5/0818* (2013.01); *B28C 5/0893* (2013.01); *B28C 5/143* (2013.01); *B28C 7/064* (2013.01); *B28C 7/065* (2013.01); *B28C 7/067* (2013.01); *B28C 7/128* (2013.01)

(58) Field of Classification Search

CPC ... B28C 5/1215; B28C 5/0818; B28C 5/0893; B28C 7/067; B28C 7/064; B28C 7/128; B28C 7/065; B28C 5/143

USPC ..... 366/11, 68, 320

See application file for complete search history.

(56) References Cited

U.S. PATENT DOCUMENTS

| | | | | |
|---|---|---|---|---|
| 128,288 A * | 6/1872 | Damant | B29C 48/355 425/377 |
| 722,113 A | 3/1903 | Koelner | |
| 789,614 A | 5/1905 | Koelner | |
| 974,588 A | 11/1910 | Olp | |
| 1,621,345 A * | 3/1927 | Anderson | B28C 5/1887 366/47 |
| 2,366,673 A | 1/1945 | Paley | |

(Continued)

FOREIGN PATENT DOCUMENTS

| | | |
|---|---|---|
| DE | 1684048 A1 | 4/1971 |
| DE | 4119261 A | 12/1992 |

(Continued)

OTHER PUBLICATIONS

Spec Mix, LLC (2018), Material Delivery System: D2W Workhorse Continuous Mixing System, pp. 1-2. www.specmix.com.

*Primary Examiner* — Charles Cooley

(74) *Attorney, Agent, or Firm* — Russell Ng PLLC; Brian F. Russell

(57) ABSTRACT

A portable mixer includes a frame, a hopper for receiving therein dry cementitious mix, and a chute rigidly coupled to the hopper that communicates with the hopper via an aperture. The hopper and chute are pivotally coupled to the frame. The portable mixer further includes an auger extending from the hopper into the chute via the aperture, a water supply system configured to apply water to cementitious mix, and a motor coupled to the auger and configured to rotate the auger to mix the dry cementitious mix with the water.

20 Claims, 6 Drawing Sheets

(56) References Cited

U.S. PATENT DOCUMENTS 2,509,543 A 5/1950 Truax
2,538,891 A * 1/1951 Zimmerman ..... B28C 5/1276 366/156.1
2,571,300 A * 10/1951 Simpson ..... B01F 7/00391 241/101.8
2,608,395 A * 8/1952 August ..... B01F 7/086 366/38
2,709,075 A * 5/1955 August ..... B01F 7/00391 366/38
2,796,184 A * 6/1957 Marion ..... B65B 69/0008 414/412
2,806,680 A 9/1957 August
2,868,591 A 1/1959 Van Herpt
2,903,960 A 9/1959 Zies
2,942,731 A 6/1960 Soldini
2,953,360 A 9/1960 Kline
2,976,025 A * 3/1961 Pro ..... B28C 9/0427 366/20
3,006,615 A * 10/1961 Mason, Jr. ..... B28C 5/1276 366/20
3,085,789 A * 4/1963 Heider ..... B01F 13/0035 366/133
3,185,451 A 5/1965 Snyder
3,186,602 A * 6/1965 Ricciardi ..... B65G 33/00 222/161
3,206,174 A 9/1965 Young
3,248,092 A 4/1966 Atkins
3,310,293 A 3/1967 Zimmerman
3,339,898 A 9/1967 Futty et al.
3,361,537 A * 1/1968 Ferrante ..... B01J 19/20 422/135
3,377,000 A 4/1968 Mason, Jr.
3,387,829 A 6/1968 Nangoh et al.
3,439,836 A 4/1969 Ricciardi
3,459,409 A * 8/1969 Goldberger ..... B28C 5/1246 366/40
3,482,821 A 12/1969 Blackwood
3,494,511 A 2/1970 Daignas
3,535,280 A 10/1970 Schnelle et al.
3,570,569 A 3/1971 Hartley et al.
3,606,277 A 9/1971 Kader
3,636,928 A 1/1972 Summer et al.
3,638,923 A * 2/1972 Pommier ..... B28C 5/44 366/56
3,710,983 A 1/1973 Ricciardi
3,724,721 A * 4/1973 Barr ..... B65B 69/0008 222/83.5
3,967,815 A * 7/1976 Backus ..... B28C 5/003 366/64
4,071,226 A 1/1978 Miller
4,117,547 A 9/1978 Mathis et al.
4,123,226 A 10/1978 Vanderveen
4,146,690 A 3/1979 Tago et al.
4,154,372 A * 5/1979 Ricciardi ..... B01F 7/081 222/238
4,187,030 A 2/1980 Godley
4,223,996 A * 9/1980 Mathis ..... B01F 7/00708 366/27
4,232,973 A * 11/1980 Ligouzat ..... B01F 7/087 366/156.2
4,361,117 A 11/1982 Tohme
4,383,093 A 5/1983 Shiraki et al.
4,428,535 A 1/1984 Venetucci
4,441,231 A 4/1984 Baccetti
4,444,509 A 4/1984 Steiner et al.
4,538,916 A * 9/1985 Zimmerman ..... B28C 9/0463 366/186
4,551,024 A 11/1985 Clapp
4,601,629 A * 7/1986 Zimmerman ..... B28C 9/0463 198/735.3
4,618,284 A 10/1986 Brown
4,619,380 A 10/1986 Brooks
4,733,607 A 3/1988 Star et al.
4,768,884 A * 9/1988 Elkin ..... B29B 9/04 366/28
4,827,455 A 5/1989 Sivachenko et al.
4,855,960 A 8/1989 Janssen et al.
4,907,890 A 3/1990 Lepper
4,940,335 A 7/1990 Gibson
4,941,132 A 7/1990 Horn et al.
4,953,752 A 9/1990 Tousignant et al.
4,956,821 A 9/1990 Fenelon
4,997,284 A 3/1991 Tousignant et al.
5,213,414 A 5/1993 Richard et al.
5,333,762 A 8/1994 Andrews
5,342,124 A 8/1994 Swisher, Jr.
5,354,127 A * 10/1994 Del Zotto ..... B01F 7/087 366/186
5,358,331 A 10/1994 Cruse
5,415,323 A 5/1995 Fenelon
5,486,047 A * 1/1996 Zimmerman ..... B01F 7/08 198/860.3
5,524,796 A 6/1996 Hyer
5,609,416 A 3/1997 Duckworth
5,624,183 A * 4/1997 Schuff ..... B01F 7/00708 366/20
5,718,508 A 2/1998 Williams
5,741,066 A 4/1998 Presnell
5,785,420 A * 7/1998 Schuff ..... B01F 7/00708 366/20
5,810,470 A 9/1998 Garrant et al.
5,876,117 A 3/1999 Chen
5,882,114 A 3/1999 Fukuyo et al.
6,000,836 A * 12/1999 Nemazi ..... B28C 5/1215 366/129
6,030,112 A * 2/2000 Milek ..... B01F 7/00391 366/320
6,099,159 A 8/2000 Yoshida et al.
6,123,445 A * 9/2000 Grassi ..... B01F 7/00708 366/157.2
6,183,560 B1 2/2001 Sarrasin
6,517,232 B1 * 2/2003 Blue ..... B01F 3/1228 366/297
6,523,727 B2 * 2/2003 Lanham, Jr. ..... A21C 5/00 222/413
6,536,602 B2 3/2003 Ruescher et al.
6,536,939 B1 * 3/2003 Blue ..... B01F 3/14 366/297
6,666,573 B2 * 12/2003 Grassi ..... B01F 5/0473 366/150.1
7,070,316 B1 7/2006 Roth
7,270,469 B2 * 9/2007 Goode ..... B28C 5/34 366/153.2
7,320,539 B2 * 1/2008 Christenson ..... B01F 7/022 366/14
7,645,064 B2 1/2010 Cestti et al.
7,784,996 B1 * 8/2010 Cummer ..... B01F 7/00158 366/50
8,408,382 B2 4/2013 Pano et al.
8,763,599 B2 7/2014 Karau et al.
9,132,952 B1 9/2015 Knepp
9,521,828 B2 12/2016 Brooks et al.
10,259,140 B1 * 4/2019 Derose ..... B28C 5/1246
10,543,620 B1 * 1/2020 Derose ..... B01F 27/1142
2002/0093876 A1 7/2002 Dillinger et al.
2003/0076737 A1 * 4/2003 Grassi ..... B01F 15/0234 366/150.1
2003/0152450 A1 8/2003 Henry et al.
2005/0068849 A1 3/2005 Eck et al.
2005/0127208 A1 * 6/2005 Kaligian, II ..... B01F 5/0451 239/432
2005/0236257 A1 10/2005 Schaer et al.
2005/0276152 A1 12/2005 Goode et al.
2006/0280026 A1 12/2006 Dackefjord
2007/0280045 A1 12/2007 Reinecke
2008/0101153 A1 5/2008 Swisher
2010/0021277 A1 1/2010 Fritz et al.
2014/0058559 A1 2/2014 Haynes

(56) References Cited

U.S. PATENT DOCUMENTS

| | | | | |
|---|---|---|---|---|
| 2016/0207014 | A1 | 7/2016 | Onan | |
| 2021/0237310 | A1 * | 8/2021 | Scott | B28C 7/064 |

FOREIGN PATENT DOCUMENTS

| | | | |
|---|---|---|---|
| DE | 202012101568 | U1 * | 4/2013 |
| EP | 584573 | B1 | 3/1998 |

* cited by examiner

PORTABLE MIXER FOR HYDRATING AND MIXING CEMENTITIOUS MIX IN A CONTINUOUS PROCESS

BACKGROUND OF THE INVENTION

The present invention relates in general to a mixer and, in particular, to a portable mixer that hydrates and mixes prepackaged cementitious mix in a continuous process.

Concrete is a building material commonly used in a variety of construction applications. In many cases, the volume of concrete required for a particular application and/or the number of personnel available to handle the uncured concrete does not warrant delivery of the concrete via a mixer or ready-mix truck. Instead, for small jobs, concrete is often prepared in batches by emptying one or more sacks of prepackaged concrete mix into a wheelbarrow, adding water in various amounts, and then mixing the resulting slurry by hand utilizing tools such as a hoe or shovel until the desired consistency is reached. For slightly bigger jobs, concrete can be mixed from bags of concrete mix or from raw materials (e.g., aggregates, cement, and water) in a rotating drum mixer, which can be powered, for example, by electricity or a gasoline or diesel motor.

BRIEF SUMMARY

The present disclosure recognizes that conventional techniques for mixing concrete have significant drawbacks. For example, the concrete slurry is frequently too wet or too dry, which can lead to a need to repetitively add more water and/or dry mix to the slurry to achieve a desired consistency. Depending upon the skill and/or experience of the individual doing the mixing, the consistency of different batches of concrete often differs significantly. Further, the work involved in cleaning the tools and the drum mixer utilized in preparation of the concrete is laborious. In fact, it is common for a drum mixer to be discarded after mixing several hundred sacks of concrete mix due to the difficulty and labor required to remove the dried and hardened concrete from the crevices and small spaces in and around the internal paddles inside the drum.

The present disclosure also recognizes that continuous process mortar mixers are currently available for mixing bags of prepackaged mortar mix for brick and stone laying, joint pointing, and other applications. Although the contents of these prepackaged mortar mixes vary depending upon the intended application and required mortar properties, prepackaged mortar mixes do not include aggregate ingredients larger in grain size than "sand," which is defined herein according to the Wentworth scale as a granular material having a grain size of between 0.062 mm and 2.0 mm. In general, prepackaged mortar mixes commonly include silica sand having a relatively homogenous grain size of about 0.5 mm. Because continuous process mortar mixers are specifically designed to exclusively mix commercial prepackaged mortar mixes, these continuous process motor mixers cannot accept or mix commercially available prepackaged concrete mixes due to their inability to accommodate the gravel aggregates present in concrete mixes, where "gravel" is defined according to the Wentworth scale as a granular material having a grain size ranging from 2.0 mm to 64.0 mm.

According to one or more embodiments, an improved portable mixer is provided that hydrates and mixes sacks of prepackaged cementitious mix, which may contain gravel aggregate, in a continuous process.

In one or more embodiments, a portable mixer includes a frame, a hopper for receiving therein dry cementitious mix, and a chute rigidly coupled to the hopper that communicates with the hopper via an aperture. The hopper and chute are pivotally coupled to the frame. The portable mixer further includes an auger extending from the hopper into the chute via the aperture, a water supply system configured to apply water to cementitious mix, and a motor coupled to the auger and configured to rotate the auger to mix the dry cementitious mix with the water.

In some embodiments, the frame of the portable mixer includes a first plate, and the portable mixer further includes a second plate pivotally coupled to the first plate by a pivot assembly. In some embodiments, the pivot assembly includes a spring that biases the second plate away from the first plate.

In some embodiments, the auger includes a first body portion and a second body portion, where the second body portion comprises a shaftless helical auger body portion. In some embodiments, the second body portion is disposed in the chute, and the second body portion has a greater pitch than the first body portion.

In at least some embodiments, the portable mixer is configured to facilitate ease of cleanup, thus reducing or eliminating the cleaning issues common to drum mixers.

DETAILED DESCRIPTION

Figures 6A, 6B, 6C:
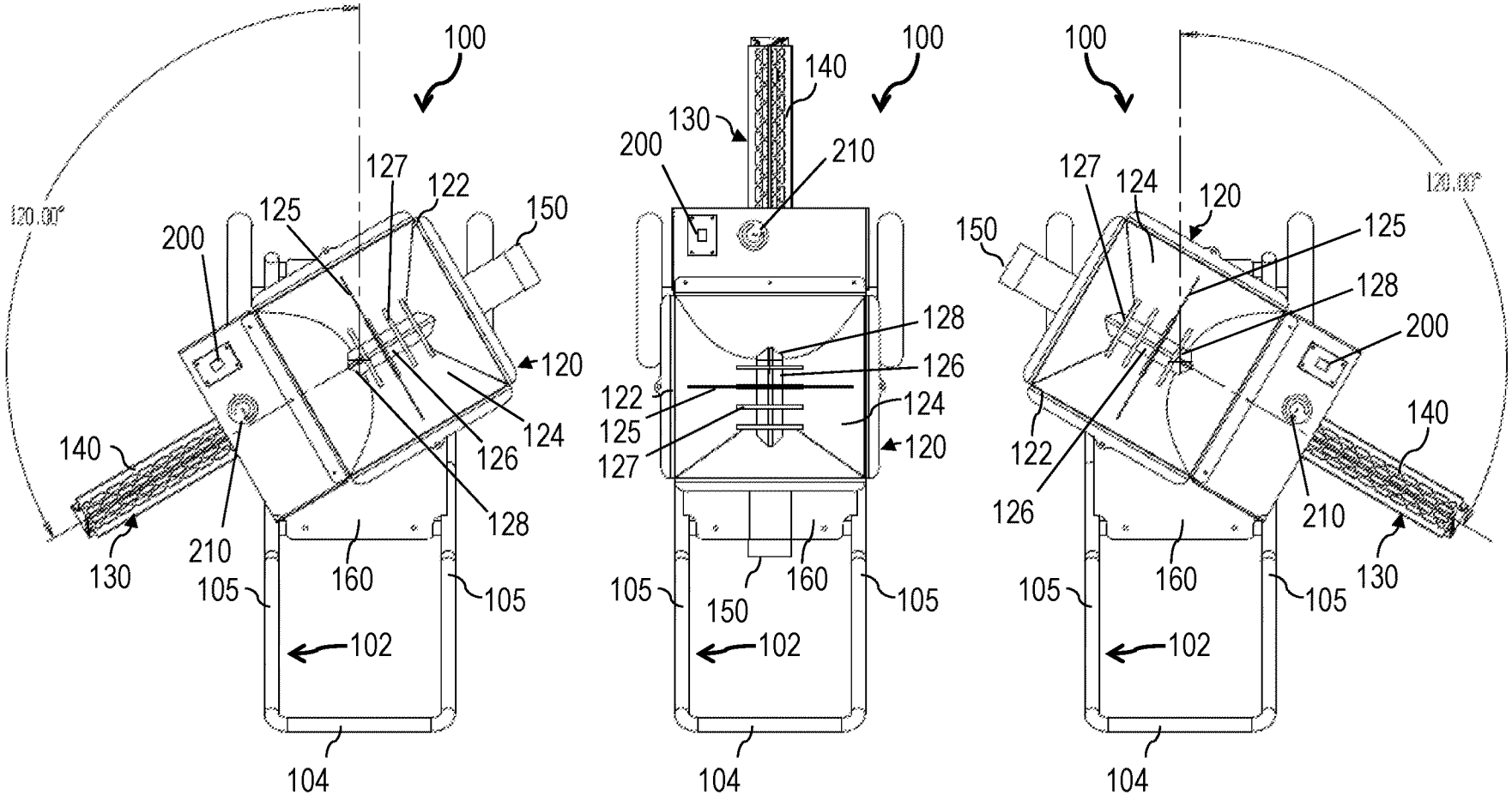
FIGS. 6A-6C are top plan views of a portable mixer having a rotatable chute in accordance with one embodiment.
Figure 7:
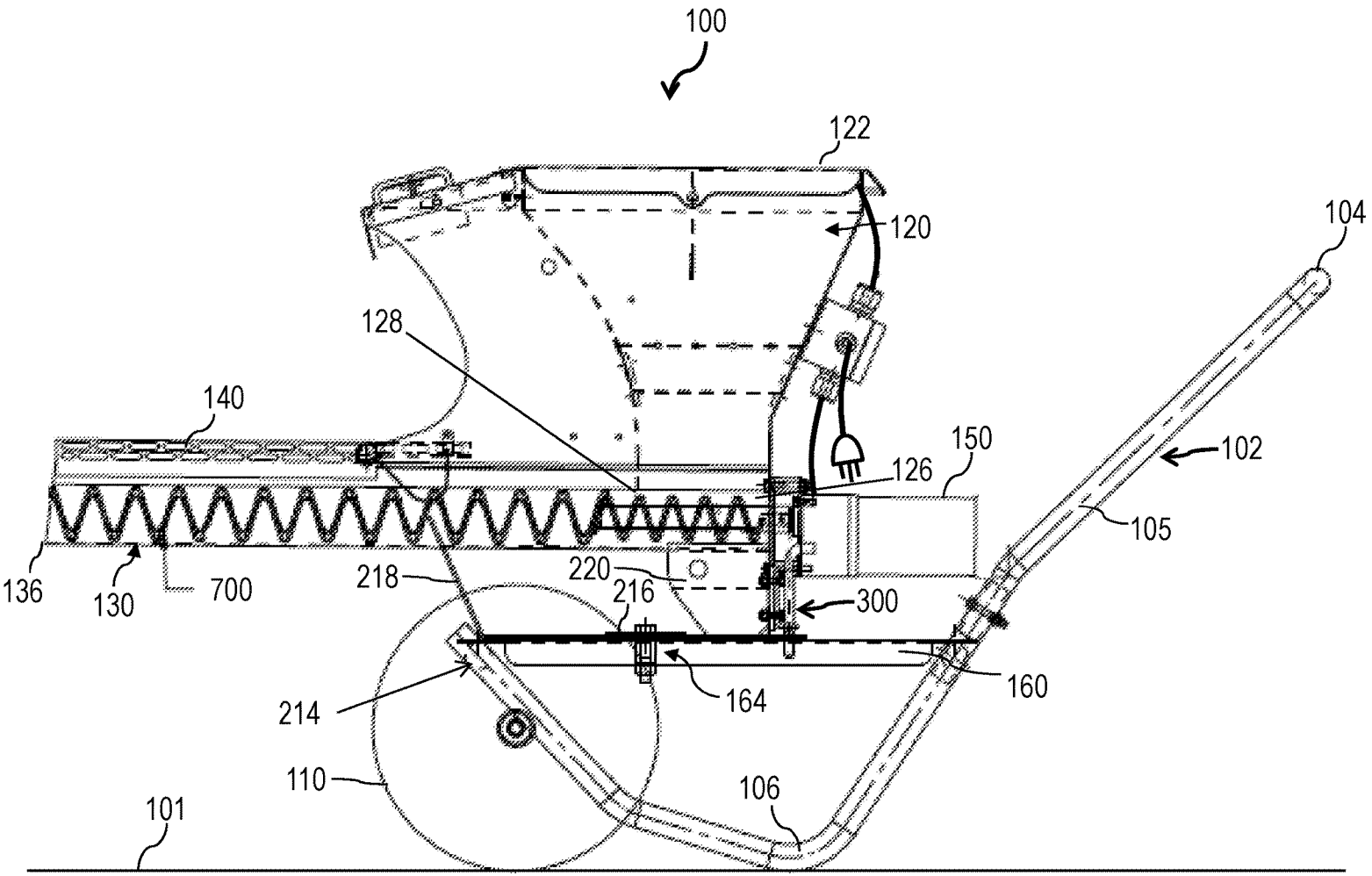
FIG. 7 is a partial section view of a portable mixer in accordance with one embodiment.

With reference now to the figures and, in particular, with reference to FIGS. 1-7, there are illustrated various views of a portable mixer 100 in accordance with one embodiment. In particular, FIGS. 1-4 provide left side, front, rear, and right side elevation views of portable mixer 100. FIGS. 6A-6C provide top plan views, and FIG. 7 provides a partial section view of mixer 100. As described further herein, portable mixer 100 can be used to hydrate and mix sacks of prepackaged cementitious mix in a continuous process. For example, portable mixer 100 can be utilized to mix standard 40-pound, 50-pound, 60-pound, or 80-pound sacks of prepackaged concrete mix or similarly sized sacks of mortar mix. In typical continuous operation, portable mixer 100 can produce approximately 1 cubic yard of concrete or mortar per hour. In different embodiments, greater or lesser output can be obtained by appropriate resizing of the auger and/or motor described herein.

Figure 1:
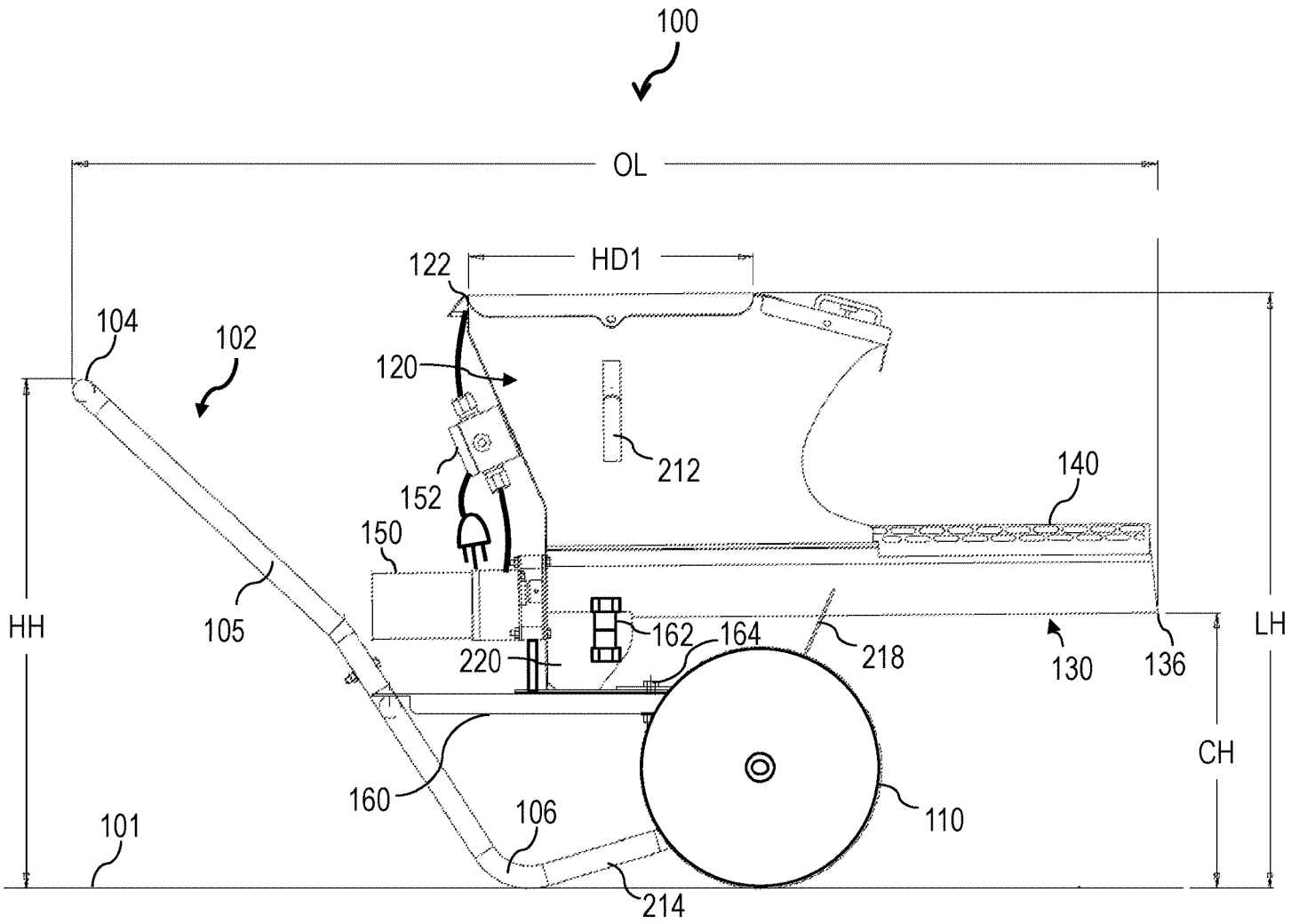
FIG. 1 is a left side elevation view of a portable mixer in accordance with one embodiment.
Figure 3:
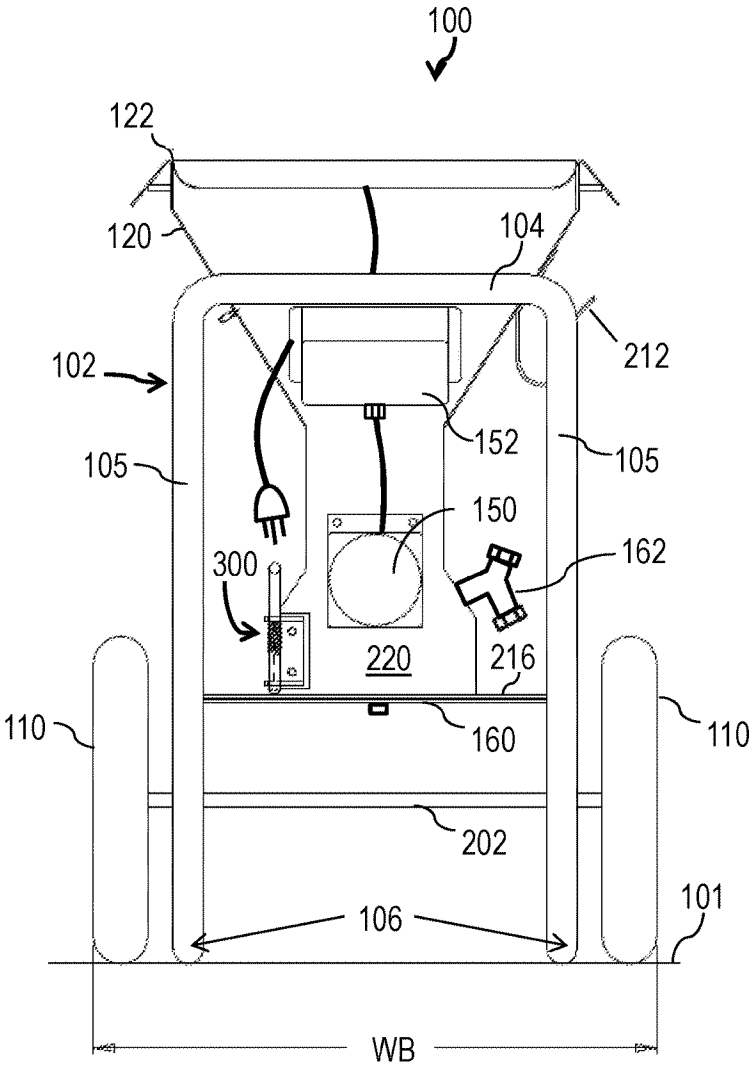
FIG. 3 is a rear elevation view of a portable mixer in accordance with one embodiment.

In the depicted embodiment, portable mixer 100 has a frame 102, which can be formed out of a durable material, such as fiberglass, plastic, wood, and/or tubular steel. Frame 102 has a handle portion 104 by which portable mixer 100 can be manually pushed or pulled to position portable mixer 100 at a desired position on a job site. In at least some embodiments, as seen, for example, in FIGS. 3 and 6A-6C, frame 102 includes left-side and right-side frame members 105 that are coupled to or integral with handle portion 104. Frame 102 additionally includes one or more (and in this example, two) rests 106, which in this example are integral with frame members 105. Rests 106 support a back portion of frame 102 on an underlying substrate 101. In the depicted embodiment, forward of rests 106 one or more (and preferably, two) wheels 110 are coupled to arm portions 214 of frame members 105 by at least one axle 202 rotatably captured in axle brackets 107. With this arrangement, a user can lift handle portion 104 of frame 102 to raise rests 106 above the underlying substrate, roll portable mixer 100 to a desired position on a job site on wheels 110, and then park portable mixer 100 in a stable condition at the desired position. In various embodiments, each wheel 110 can include a central rim on which a pneumatic or foam-filled tire is mounted, or alternatively, can be formed of a solid disk (e.g., of plastic or fiberglass). Portable mixer 100 can have a wheel base (WB) as shown in FIG. 3 in a range of between about 20 and 36 inches and, more particularly, in a range of between about 22 and 30 inches, and still more particularly between about 24 and 26 inches.

When portable mixer 100 is parked on a level substrate 101 as shown in FIGS. 1-4, the handle height HH of handle portion 104 above level substrate 101 can vary between embodiments and can, in some embodiments, be adjustable. In some embodiments, handle height HH can be between in a range of between about 24 to 36 inches, and more particularly, between about 28 to 32 inches.

Portable mixer 100 further includes a hopper 120 for receiving therein dry prepackaged cementitious mix (e.g., Sakrete™, Quikrete™, or mortar mix), which typically includes predetermined proportions of cement, accelerants, retardants, binders, possibly aggregate (e.g., gravel and/or sand), and other proprietary chemicals to enhance final product performance. Prepackaged concrete mixes commonly include locally sourced natural or crushed rock or recycled concrete aggregate having a grain size greater than 0.19 inches (about 3 mm), and more commonly, between 0.375 and 1.5 inches. This gravel aggregate commonly forms between 60% and 75% of the total volume of a prepackaged concrete mix. Hopper 120 is preferably formed out of a durable material, such as fiberglass, plastic, or sheet metal (e.g., steel). As shown, hopper 120 has a rim 122, one or more inwardly sloping sidewalls 124 with a slope appropriate to ensure smooth delivery/discharge recognizing the repose angle of the prepackaged cementitious mix being utilized, and a base 126 to which concrete mix placed in hopper 120 is uniformly funneled/dispensed under gravitational force. Near base 126, a sidewall 124 has an aperture 128 formed therein through which an auger 700 extends and through which prepackaged cementitious mix is transported by the rotation of the auger 700, as discussed further below.

As shown, hopper 120 can conveniently include a bag opener 125, which in the illustrated embodiment comprises an upwardly arched serrated blade. In a preferred embodiment, the sidewall(s) 124 of hopper 120 are spaced such that the leading surface of an unopened sack of prepackaged cementitious mix dropped into hopper 120 will be deformed convexly and placed under tension through the contact of the sack with the sidewall(s) 124 of hopper 120. Bag opener 125 is preferably located substantially centrally front-to-back within hopper 120 and at a height relative to the inward slope of sidewall(s) 124 such that bag opener 125 will perforate the tensioned, leading convex surface of the sack, allowing the cementitious mix contained therein to spill into hopper 120 under the urging of gravity. Once perforated, the sack is preferably left in hopper 120 until a majority of the sack's contents have spilled out in order to reduce the amount of air-borne silica dust. After the sack is mostly emptied, the sack can be lifted by its ends to completely empty its contents into hopper 120 and can then be removed from the top of hopper 120.

Hopper 120 can have a variety of shapes and/or sizes in different embodiments. For example, hopper 120 can have an ovoid or rectangular or other cross-section. Further, the cross-sectional shape of a hopper 120 can vary between rim 122 and base 128. In the illustrated embodiment in which hopper 120 has a generally rectangular cross-section at rim 122, hopper 120 has maximum orthogonal dimensions HD1 and HD2 between about 12 and 24 inches across at rim 122, and more particularly, between about 15 and 20 inches, and still more particularly, between about 16 and 18 inches. Further, in some embodiments, hopper 120 is between about 8 and 25 inches deep measured between rim 122 and base 128, and more particularly, between about 10 and 20 inches deep. In these embodiments, hopper 120 can be sized to hold approximately 100 pounds of dry cementitious mix.

In at least some preferred embodiments, it is desirable for portable mixer 100 to be easy for one or two person work crews to lift, transport, deploy, and use. For example, in some embodiments, an unloaded portable mixer 100 can be less than about 100 pounds, and still more preferably, less than about 80 pounds. In addition, frame 102, wheels 110, and hopper 120 are sized and configured such that the load height (LH) of rim 122 of hopper 120 is less than about four feet above the underlying substrate 101, and more preferably, in the range of between about 24 inches and 42 inches above the underlying substrate 101. This height range makes the task of lifting sacks of cementitious mix and loading their contents into the top of hopper 120 much easier and safer than loading a conventional barrel mixer.

Aperture 128 of hopper 120 communicates with a chute 130 that extends between a sidewall 124 of hopper 120 and an open end 136. In one exemplary embodiment, chute 130 is between about 16 and 30 inches in length, and more particularly, between about 16 and 24 inches, and still more particularly, between about 16 and 20 inches in length. These ranges of lengths allow portable mixer 100 to remain compact, while providing sufficient opportunity for the cementitious mix to be thoroughly mixed with water as it traverses chute 130. In some embodiments, these ranges of chute lengths result in portable mixer 100 having an overall length (OL) of between about 50 and 72 inches, and more particularly, between about 60 and 70 inches. When rests 106 of portable mixer 100 are resting on a level substrate 101, chute 130 can have an inclination or declination relative to substrate 101 from aperture 128 of hopper 120 to open end 136 or can be substantially parallel with substrate 101 (as shown). In various embodiments, open end 136 of chute 130 can have a range of chute heights (CH) when rests 106 of portable mixer 100 are resting on a level substrate 101. For example, in some embodiments, portable mixer 100 can have a chute height (CH) of between about 12 and 24 inches, and more particularly, between about 12 and 20 inches.

In at least some embodiments, chute 130 is a curved, at least partially enclosed tube. In some embodiments, the top of chute 130 can be at least partially open along its length to facilitate cleaning and maintenance. In such embodiments, the open top of chute 130 is optionally but preferably covered during rotation of auger 700 by a guard 140, which reduces the likelihood of injury due to the inadvertent contact of a user's body or clothing with a rotating auger 700. In at least some preferred embodiments, guard 140 is pivotally or otherwise coupled to chute 130 so that a user can move guard 140 up and away from the top of chute 130 for ease of cleaning. In some embodiments, a grill 127 can similarly be disposed in hopper 120. For example, in one example, grill 127 may include a series of rods penetrating through holes in the sidewall(s) 124 of hopper 120.

In at least some embodiments, chute 130 may be formed integrally (i.e., as a unitary piece) with hopper 120, for example, by injection molding. In at least some embodiments, chute 130 may optionally further include a hold down strap (not illustrated) that limits the axial displacement of auger 700 (e.g., as it is displaced from axial alignment by contact with gravel aggregate in the concrete mix).

Portable mixer 100 additionally includes a motor 150 for rotating auger 700. In the depicted example, motor 150 is an electric motor, which is removably coupled (e.g., by bolts) to the lower back surface of hopper 120. In this arrangement, a small through hole in hopper 120 (not specifically illustrated) allows a motor shaft of motor 150 to be coupled to and axially rotate auger 700. For example, in some embodiments, the motor shaft of electric motor 150 is coupled to auger 700 by a left hand Acme thread. In other embodiments, the motor shaft and auger 700 can be coupled by a clevis pin that passes through corresponding through holes in the motor shaft and auger 700. In some embodiments, electric motor 150 can be powered by standard 110-230 V AC mains power, which, if electric motor 150 is a DC motor, can be transformed into DC power of suitable voltage, for example, by a power transformer disposed within electrical enclosure 152. In other embodiments, electric motor 150 can alternatively or additionally be powered by a battery, such as a standard 12 V DC automobile battery. In at least some embodiments, the power system of portable mixer 100 includes a manual multi-position switch 200 that allows to auger 700 to be selectively operated by a user in a forward direction in which cementitious mix is moved by auger 700 from hopper 120 in chute 130 or in a reverse direction or stopped. Although the illustrated embodiment employs an electric motor (e.g., a fixed or variable speed DC or AC motor), it should be appreciated that motor 150 can alternatively be implemented with a gasoline or diesel-powered engine.

Figure 2:
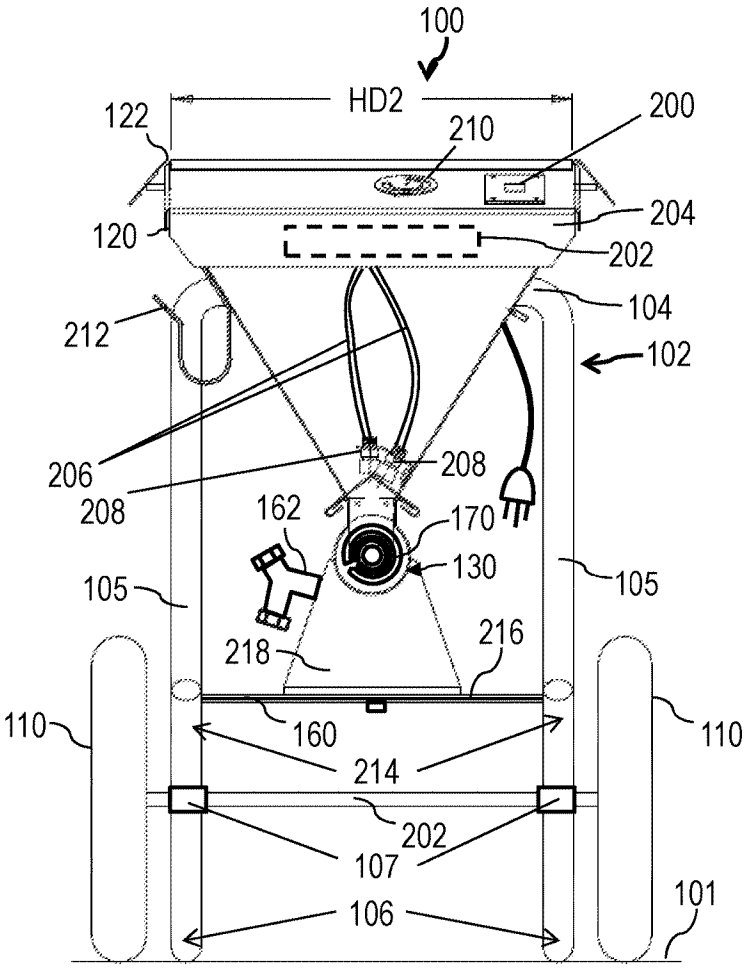
FIG. 2 is a front elevation view of a portable mixer in accordance with one embodiment.
Figure 5:
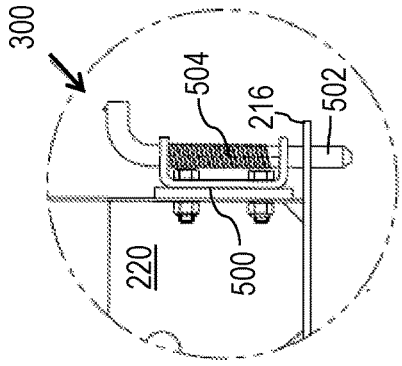
FIG. 5 is a detailed view of a latch assembly in accordance with one embodiment.
Figure 4:
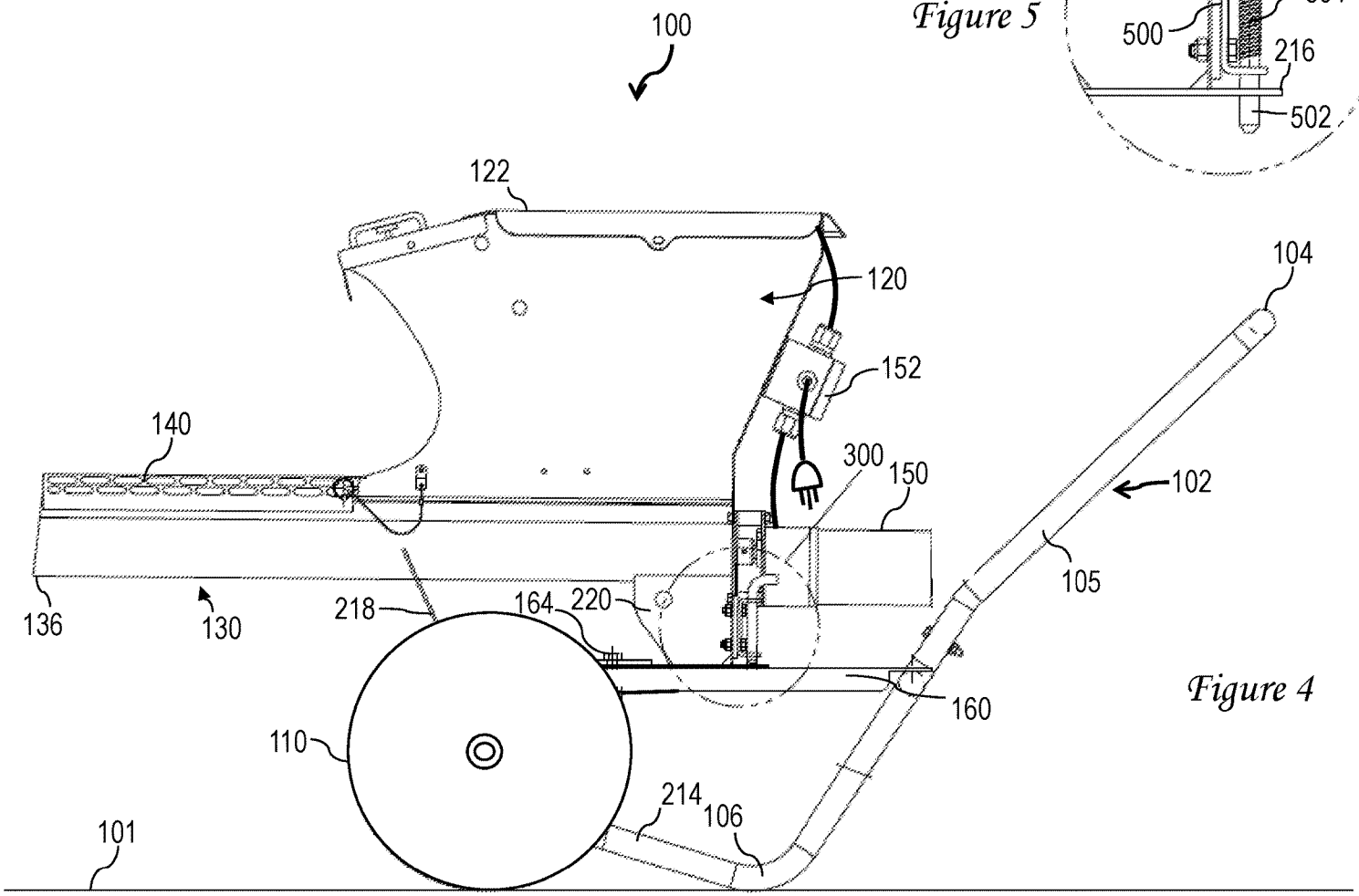
FIG. 4 is a right side elevation view of a portable mixer in accordance with one embodiment.

Portable mixer 100 additionally includes a water supply system best seen in FIGS. 2-3. The water supply system includes a connector 162, such as a standard ¾ inch female hose connector or "quick connect" connector, which supports attachment of a standard garden hose or water tank to provide a continuous supply of water. The input water flows through unillustrated tubing to a metering device 202, such as a solenoid and/or manually actuated valve, which in the illustrated embodiment is mounted below and behind a front apron 204. Metering device 202 controls the flow rate of water applied by portable mixer 100 to the cementitious mix through tubing 206 and one or more spray nozzles 208. In at least some embodiments, portable mixer 100 includes a user selectable flow control 210, for example, a control knob or lever that permit the operator to adjust the flow rate determined by metering device. For example, in humid, damp, or wet conditions or in applications in which a drier mix is desired, the user can decrease the rate at which water is introduced into the cementitious mix, and in dry conditions or in applications in which a wetter mix is desired, the user can increase the rate at which water introduced into the cementitious mix in order to achieve a desired slurry consistency. Thus, in at least some embodiments, the quantity of water supplied by water supply system is operator-controlled and is non-volumetric with respect to the quantity of cementitious mix loaded into hopper 120.

Although in various embodiments, the water supply system can introduce water into the dry cementitious mix in various locations, including inside hopper 120, in at least some preferred embodiments like that depicted in FIG. 2, spray nozzle(s) 208 forcibly spray water onto the dry cementitious mix in chute 130 at a point close to aperture 128. This configuration provides adequate time for capillary action to disperse the water, permits use of a relatively short chute 130, and improves the homogeneity of the final slurry at the end of chute 130.

In some embodiments like that illustrated in FIG. 2, connector 162 of the water supply system provides an additional connection for an optional spray hose that may be utilized by the operator to clean hopper 120 and chute 130 after use. This spray hose may conveniently be stowed between uses on hose hanger 212.

In some embodiments, hopper 120 and chute 130 may be coupled in fixed relation to frame 102. However, in other embodiments, at least chute 130 may be movable in relation to frame 102. For example, in the embodiment depicted in FIGS. 1-7, hopper 120 and chute 130 are together pivotally coupled to frame 102. In this embodiment, frame 102 includes a lower plate 160 coupled between arm portions 214 of frame 102 and the portions of frame members 105 extending rearward of rests 106. Lower plate 160 can be oriented to be generally parallel with level substrate 101.

In the depicted embodiment, portable mixer 100 additionally includes an upper plate 216 (see, e.g., FIGS. 2-3) that is rigidly coupled to chute 130 and to hopper 120 by fore and aft flanges 218 and 220, respectively. Upper plate 216 is pivotally coupled to lower plate 160 by a pivot assembly 164, which in the illustrated embodiment is implemented with a die spring assembly including a central bolt passing through a die spring that biases upper plate 216 away from lower plate 160. The pivotal coupling of upper plate 216 and lower plate 160 enables chute 130 to be selectively rotated with respect to frame 102, for example, up to 120 degrees on either side of center, as shown in FIGS. 6A-6C. In order to secure chute 130 in a desired position relative to frame 102, portable mixer 100 may optionally a latch assembly 300. In the embodiment depicted in drawings and best seen in FIG. 5, latch assembly 300 comprises a bracket 500 mounted on aft flange 220. Bracket 500 houses a spring-loaded barrel bolt 502 that is biased by its spring 504 toward a locked state in which spring-loaded barrel bolt 502 engages corresponding through holes in upper plate 216 and lower plate 160. Spring-loaded barrel bolt 502 can then be selectively withdrawn from the through holes to permit free rotation of chute 130 relative to frame 102 and then returned to the locked state by the urging of spring 504 (as long as the through hole of upper plate 216 is aligned with a corresponding through hole in lower plate 160).

Figure 8:
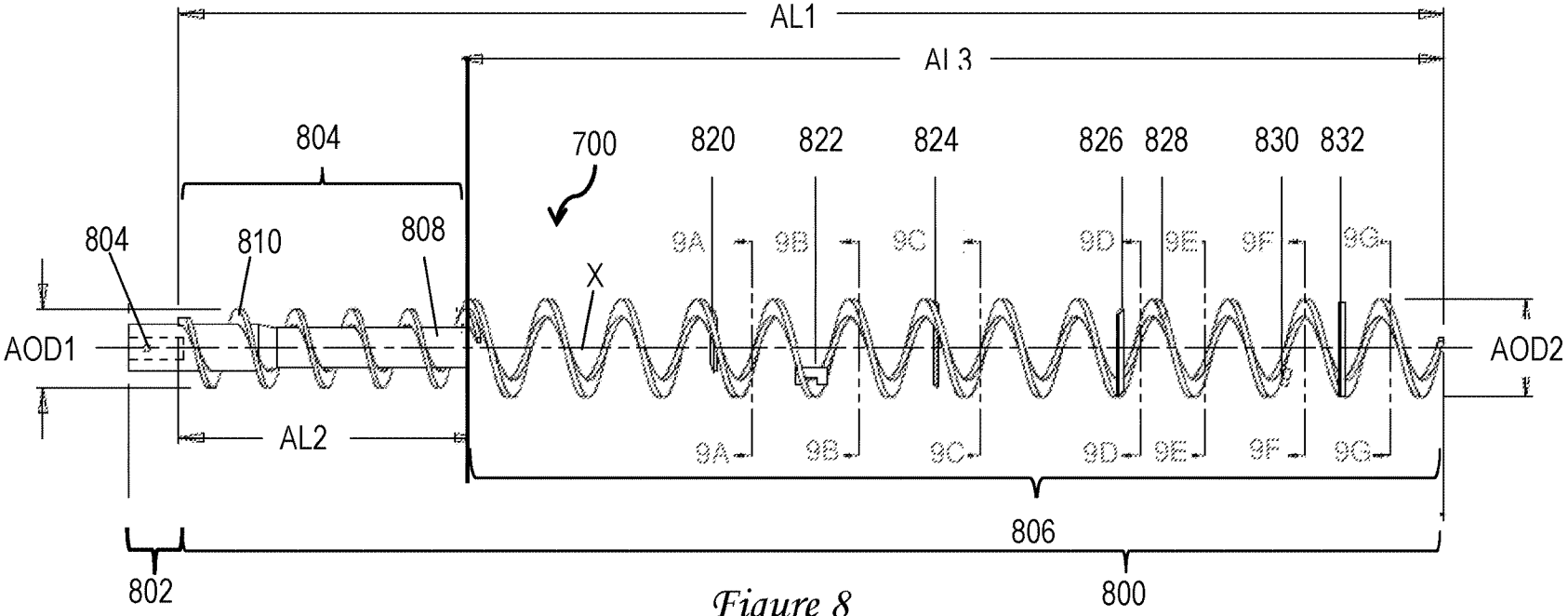
FIG. 8 is a detailed elevation view of an auger for a portable mixer in accordance with one embodiment.

Referring now to FIG. 8, there is depicted a more detailed view of an auger 700 in accordance with one embodiment. As noted above, auger 700 is coupled to and rotatable by motor 150 to transport dry cementitious mix from hopper 120 through aperture 128 into chute 130, to mix the cementitious mix with water in chute 130, and to transport the resulting ready-to-use slurry to open end 136 of chute 130. In depicted embodiment, auger 700, which is preferably formed of steel or other durable metal, includes an auger body 800 and a lug 802 by which auger 700 is coupled to the motor shaft of motor 150. In the illustrated example, lug 802 has a through hole 804 by which lug 802 can be coupled to the motor shaft by a clevis pin, as discussed above. The selected configuration of auger body 800 preferably promotes efficient transport of cementitious mix from hopper 120 to chute 130, thorough mixing within chute 130 of the cementitious mix and the water provided by the water supply system, and efficient transport of the cementitious slurry out of chute 130 through open end 136.

In the embodiment depicted in FIGS. 7-8, auger body 800 is elongate and has a length along its long axis X that is selected to continuously span substantially all of the length of base 126 of hopper 120 and chute 130. Thus, for example, in some embodiments, auger body 800 may have an overall length AL1 between about 28 and 54 inches, and more particularly, between about 30 and 40 inches. Auger body 800 includes a first body portion 804 and a second body portion 806. First body portion 804 includes a central shaft 808 surrounded by a helical flighting 810 continuously curving in single direction (in the illustrated embodiment, a right-handed helix). As depicted in FIG. 7, first body portion 804 preferably has a length AL2 selected to span substantially all of base 126 of hopper 120, and in some embodiments, to extend into chute 130. For example, in some embodiments, length AL2 of first body portion 804 may be between about 6 inches to 12 inches, and more particularly, between about 8 inches to 10 inches. In some embodiments, first body portion 804 may have a substantially uniform outer diameter AOD1 measured orthogonally to the long axis X of auger 700 of between about 1.75 and 2.75 inches, and more particularly, between about 2.0 and 2.5 inches.

In at least some embodiments, second body portion 806 of auger body 800 takes the form of a shaftless open helix (also referred to as a shaftless flight) continuously curving in single direction (e.g., a right-handed helix like flighting 810). Second body portion 806 may in some embodiments have a length AL3 between about 18 and 42 inches, and more particularly, between about 20 and 30 inches. Second body portion 806 may be rigidly coupled to first body portion 804, for example, by one or more welds between flighting 810 of first body portion 804 and second body portion 806. In other embodiments, second body portion 806 can be formed as a unitary piece with flighting 810. The absence of a central shaft in second body portion 806 promotes more thorough mixing of the water with the cementitious mix and eliminates the numerous joints and crevices where slurry can more easily escape the cleaning process and thus build up and eventually retard the advancement of the slurry down the chute and degrade the ultimate mixing effectiveness of auger 700. The absence of a central shaft in second body portion 806 also allows the portable mixer 100 to accommodate the use of prepackaged concrete mixes with large gravel aggregates (e.g., 0.75 to 1.0 inch). In some embodiments, second body portion 806 has a substantially uniform outer diameter AOD2 measured orthogonally to the long axis X of auger 700 of between 2.25 and 3.25 inches, and more particularly, between about 2.5 and 3.0 inches. In general, it is preferred if AOD2 is greater than AOD1.

Auger body 800 also preferably has an uneven pitch. In particular, flighting 810 of first body portion 804 preferably has a lesser first pitch, while the shaftless flight of second body portion 806 preferably has a greater second pitch. In various embodiments, the greater pitch of second body portion 806 can either be fixed or can increase uniformly or step-wise over some or all of the length of second body portion 806 as it extends from first body portion 804 toward open end 136. As one example, first body portion 804 may have a pitch-to-diameter ratio of between about 0.2 and 0.9, and more particularly, between about 0.5 and 0.8, and more particularly, of about 0.7 (e.g., a pitch of 1.6 inches for an AOD1 of 2.2 inches). In this example, second body portion 806 can have a pitch-to-diameter ratio at open end 136 of chute 130 in the range of between about 0.4 to 1.8, and more particularly, of between about 0.6 to 1.0, and more particularly, of between about 0.7 to 0.8 (e.g., a pitch of 2.1 for an AOD2 of 2.7 inches).

As further illustrated in FIG. 8 and depicted in FIGS. 9A-9G (which illustrate section views taken along lines 9A-9A through 9G-9G, respectively, of FIG. 8) in at least some embodiments, second body portion 806 has at least one, and preferably a plurality of, elements extending from the helix of second body portion 806 into the interior volume of the helix. In the exemplary embodiment, these elements are of disparate configurations and orientations and have irregular lengths and spacings. In this particular example, these elements include a plurality of fingers 820. Fingers 820 function to interrupt and retard the flow of the wetted cementitious mixture and to increase internal shear, thus improving the uniformity of mixing and ensuring a more homogeneous final mixture. Although the depicted embodiment employs fingers 820 that are formed of flat metal bar of rectangular cross-section, it should be appreciated that fingers 820 can alternatively or additionally take other cross-sectional shapes or combinations of shapes such as a cylindrical (or other cross-sectionally shaped) rods in combination with a flat metal bar. It should be appreciated that in some embodiments there must be a minimum of one finger 820, with the best performance resulting from utilizing multiple fingers 820.

In one embodiment of auger 700 in which second body portion 806 is about 27 inches long and has an outer diameter of about 2.75 inches, second body portion 806 includes four fingers 820*a*-820*d*, with the first (i.e., finger 820*a*) spaced between about 7 and 8 inches from the end of shaft 808 (which in some embodiments, extends through aperture 128 into chute 130), the second (i.e., finger 820*b*) positioned between about six to seven inches further down chute 130 toward open end 136, the third (i.e., finger 820*c*) positioned between about five to six inches further down chute 130, and the fourth (i.e., finger 820*d*) positioned between about six to seven inches further down chute 130. Each of fingers 820*a*-820*d* is preferably substantially orthogonal to the long axis X of auger 700. The increased pitch of second body portion 806 is preferably selected to counter the resistance in flow (and velocity) offered by fingers 820*a*-820*d*. The increase in pitch of the helix in second body portion 806 moves the cementitious mix along chute 130 with enough relative velocity to reduce or eliminate unwanted material build-up in chute 130. As best seen in FIGS. 9A, 9C, 9D, and 9G, the lengths of fingers 820*a*-820*d* preferably increase the further along chute 130 the fingers are positioned. For example, length FL1 of finger 820*a* measured orthogonally to long axis X of auger 700 may be about 2 inches, length FL2 of finger 820*b* and length FL3 of finger 820*c* may be about 2.4 inches, and length FL4 may be about 2.6 inches. Fingers 820*a*-820*d* are also preferably oriented at differing angles relative to the circular cross-section of second body portion 806. For example, in the given radial position of auger 700 depicted in FIGS. 9A, 9C, 9D, and 9G, fingers 820*a*-820*d* are oriented at about 135 degrees, about 105 degrees, about 95 degrees and about 90 degrees, respectively.

Figures 9A, 9B, 9C, 9D, 9E, 9F, 9G:
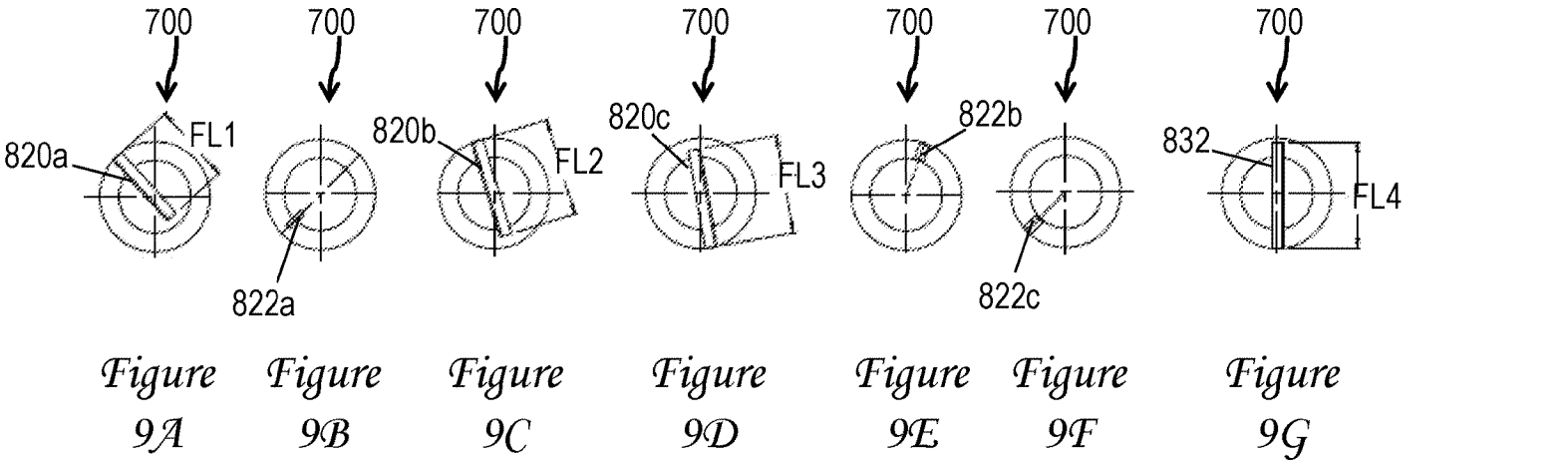
FIGS. 9A-9G are sections views of the auger depicted in FIG. 8.

As further depicted in FIG. 8 and additionally in the section views provided in FIGS. 9B, 9E, and 9F, in some embodiments the elements extending from the helix of second body portion 806 into the interior volume of the helix additionally include one or more paddles 822 (e.g., 822*a*-822*c*). In the illustrated embodiment, each paddle is a small rectangular bar having its largest surface area substantially orthogonal to the portion of the fighting of second body portion 806 to which it is attached.

Although the portable mixer 100 described herein is capable of continuous operation, it should be appreciated that the flow of cementitious slurry from chute 130 is continuous for only as long as the operator desires. If desired, the operator can stop the rotation of auger 700 for perhaps 15 or 20 minutes with partially mixed cementitious mix in chute 130 and then resume operation without any problem in the working properties of the resulting cementitious slurry.

As has been described, in at least some embodiments, a portable mixer includes a portable mixer includes a frame, a hopper for receiving therein dry cementitious mix, and a chute rigidly coupled to the hopper that communicates with the hopper via an aperture. The hopper and chute are pivotally coupled to the frame. The portable mixer further includes an auger extending from the hopper into the chute via the aperture, a water supply system configured to apply water to cementitious mix, and a motor coupled to the auger and configured to rotate the auger to mix the dry cementitious mix with the water.

While various embodiments have been particularly shown and described, it will be understood by those skilled in the art that various changes in form and detail may be made therein without departing from the spirit and scope of the appended claims and these alternate implementations all fall within the scope of the appended claims. References herein to an embodiment or embodiments do not necessarily refer to the same embodiment or embodiments. It should also be appreciated that various of the disclosed embodiments or features thereof may be utilized in combination. The terms "about" or "approximately," when used to modify quantities or ranges, are defined to mean the stated value(s) plus or minus 10%. The term "coupled" is defined to mean that elements are unitary or are attached, possibly through one or more intermediate members. Further, the term "exemplary" is defined herein as meaning one example of the described feature, but not necessarily the only or preferred example of the feature.

What is claimed is:

1. A portable mixer, comprising:

a frame having a handle portion configured for manual positioning of the portable mixer, wherein the frame includes a first plate;

a hopper for receiving therein dry cementitious mix, wherein the hopper has an aperture formed therein;

a chute rigidly coupled to the hopper and communicating with the hopper via the aperture, wherein the hopper and chute are coupled to and supported by a second plate;

a pivot assembly pivotally coupling the second plate to the first plate such that the second plate is supported by, and selectively rotatable with respect to, the first plate;

an auger extending from the hopper into the chute via the aperture;

a water supply system configured to apply water to cementitious mix; and a motor coupled to the auger and configured to rotate the auger to mix the dry cementitious mix with the water.

2. The portable mixer of claim 1, wherein the motor is a DC motor.

3. The portable mixer of claim 2, wherein the portable mixer further comprises an AC-to-DC transformer.

4. The portable mixer of claim 1, wherein the motor is coupled to the hopper.

5. The portable mixer of claim 1, and further comprising at least one wheel coupled to the frame.

6. The portable mixer of claim 5, wherein the frame further includes a plurality of rests for supporting the portable mixer on a substrate.

7. The portable mixer of claim 1, wherein:

the portable mixer has a first side and an opposing second side; and the frame includes at least one frame member extending from the first side to the second side.

8. The portable mixer of claim 1, wherein at least a portion of the auger is covered by a guard.

9. The portable mixer of claim 8, wherein the guard is pivotally coupled to the hopper.

10. The portable mixer of claim 1, and further comprising a bag opening blade disposed within the hopper.

11. The portable mixer of claim 1, wherein the water supply system includes a spray nozzle that provides water to the chute.

12. The portable mixer of claim 1, wherein the hopper has a rim having a maximum lift height of less than about 42 inches.

13. The portable mixer of claim 1, wherein:

the auger includes a first body portion and a second body portion;

the second body portion comprises a shaftless helical auger body portion.

14. The portable mixer of claim 13, wherein:

the second body portion is disposed in the chute; and the second body portion has a greater pitch than the first body portion.

15. The portable mixer of claim 13, wherein the first body portion has a pitch-to-diameter ratio of between about 0.5 and 0.8.

16. The portable mixer of claim 13, wherein the second body portion of the auger body has a pitch-to-diameter ratio of between about 0.6 and 1.0.

17. The portable mixer of claim 13, wherein the shaftless helical auger body portion includes a shaftless flight and a plurality of fingers inwardly extending from the shaftless flight.

18. The portable mixer of claim 1, wherein the chute has a length of approximately 16 to 30 inches.

19. The portable mixer of claim 1, wherein the pivot assembly includes a spring that biases the second plate away from the first plate.

20. The portable mixer of claim 1, wherein the hopper and chute are pivotal with the second plate at least about 240 degrees with respect to the frame.

* * * * *